US006776066B2

(12) United States Patent
Braun et al.

(10) Patent No.: US 6,776,066 B2
(45) Date of Patent: Aug. 17, 2004

(54) HAND LEVER

(75) Inventors: Otto Braun, Horb-Bildechingen (DE); Sascha Fischer, Empfingen (DE)

(73) Assignee: Heinrich Kipp Werk Spanntechnik + Normelemente, Sulz (DE)

( * ) Notice: Subject to any disclaimer, the term of this patent is extended or adjusted under 35 U.S.C. 154(b) by 0 days.

(21) Appl. No.: 09/997,078

(22) Filed: Nov. 29, 2001

(65) Prior Publication Data

US 2002/0062711 A1 May 30, 2002

(30) Foreign Application Priority Data

Nov. 30, 2000 (DE) ..... 200 20 296 U

(51) Int. Cl.[7] ..... G05G 1/04
(52) U.S. Cl. ..... 74/523; 74/525
(58) Field of Search ..... 74/523, 525, 524; 403/359.1, 359.3, 359.4, 359.5

(56) References Cited

U.S. PATENT DOCUMENTS 2,797,592 A 7/1957 Marrapese
2,899,841 A 8/1959 Melloy

FOREIGN PATENT DOCUMENTS

CH 569219 11/1975
EP 0271982 6/1988

*Primary Examiner*—David A. Bucci
*Assistant Examiner*—Bradley J. VanPelt
(74) *Attorney, Agent, or Firm*—Friedrich Kueffner

(57) ABSTRACT

A hand lever includes a sleeve-shaped member having an inwardly protruding projection, a fastening element having a stop interacting with the projection, wherein the fastening element is mounted in the sleeve-shaped member so as to be longitudinally slidable to a limited extent, and coupling elements for axially coupling the hand lever and fastening element so as to be nonrotatable relative to each other. A spring is mounted in the sleeve-shaped member for an axially engageable and disengageable coupling of the hand lever and the fastening element. The fastening element has an integrally formed extension part extending past the projection of the sleeve-shaped member into the sleeve-shaped member. A second support is provided for the spring and the stop of the fastening element or the extension part. At least one of the sleeve-shaped member and the extension part is of a resilient material.

10 Claims, 3 Drawing Sheets

HAND LEVER

BACKGROUND OF THE INVENTION

1. Field of the Invention

The present invention relates to a hand lever which includes a sleeve-shaped member having an inwardly protruding projection, wherein a fastening element having a stop interacting with the projection is mounted in the sleeve-shaped member so as to be axially movable to a limited extent. The hand lever is axially coupled by means of coupling elements to the fastening element so as to be nonrotatable relative to the fastening element. A spring supported at one end thereof in the sleeve-shaped member is provided for axially engaging and disengaging the coupling between the hand lever and the fastening element.

2. Description of the Related Art

A preferred field in which these hand levers are used are clamping levers as they are used in technical applications, for example, clamping devices for holding workpieces which are processed on machine tools. Hand levers of this type which are known in the prior art have the disadvantage that they are frequently expensive and complicated to manufacture.

SUMMARY OF THE INVENTION

Therefore, it is the primary object of the present invention to further develop a hand lever with fastening element of the above-described type in such a way that it can be manufactured simply and inexpensively.

In accordance with the present invention, the fastening element extends as an integral piece beyond the projection of the sleeve-shaped member in the form of an extension part into the sleeve-shaped member, wherein a second support for the spring at the stop is provided at the fastening element or the extension part thereof. In particular, at least one of the sleeve-shaped member and the extension part is of a resilient material.

As a result of the configuration according to the present invention, the hand lever can now be manufactured very inexpensively of plastics material and also the assembly of the components is very simple. It is no longer necessary to screw the components together because the components can be simply pushed together and locked relative to each other because of the resiliency of the material.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
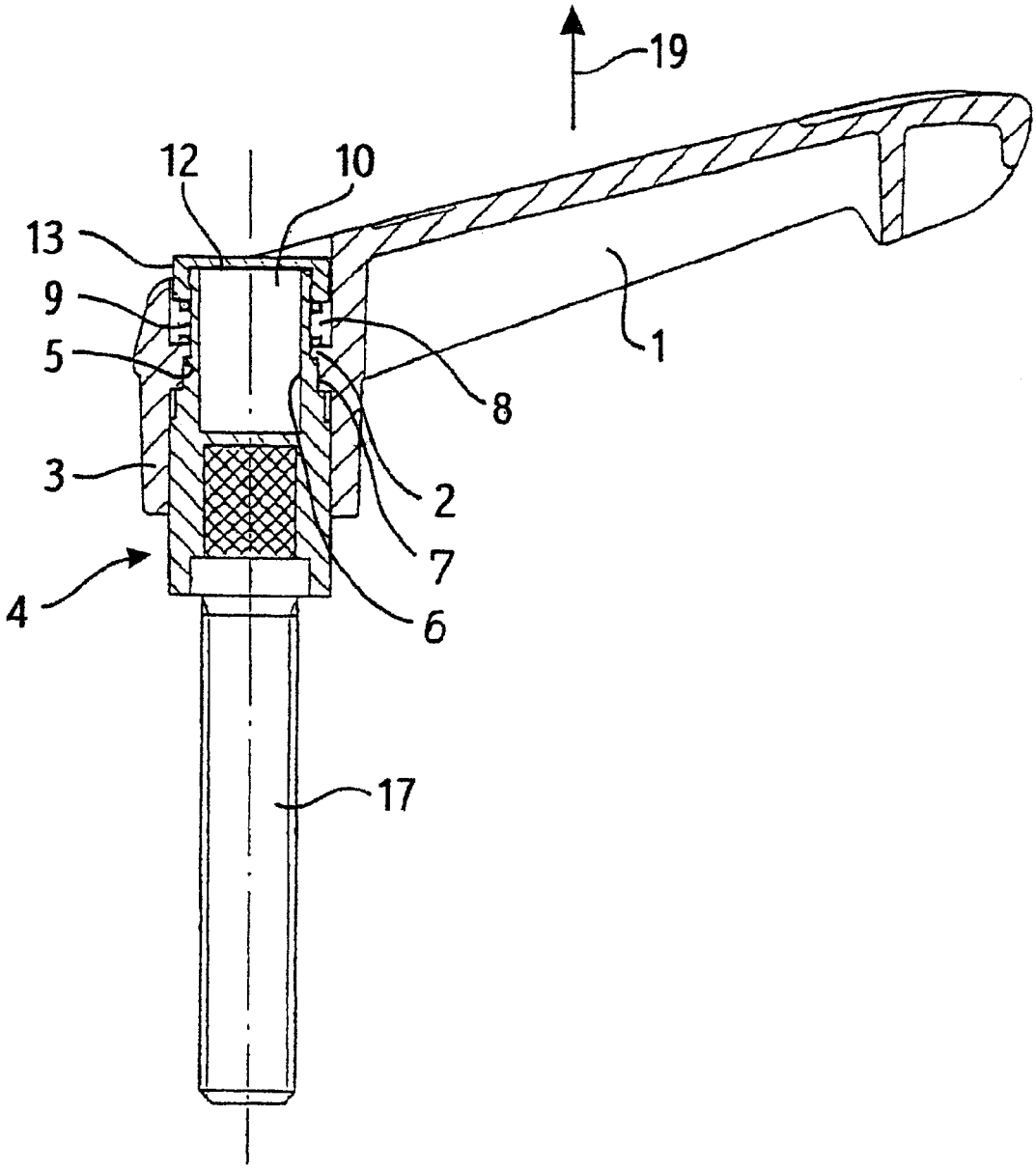
FIG. 1 is a sectional view of a hand lever with fastening element in accordance with a first embodiment of the invention.
Figure 2:
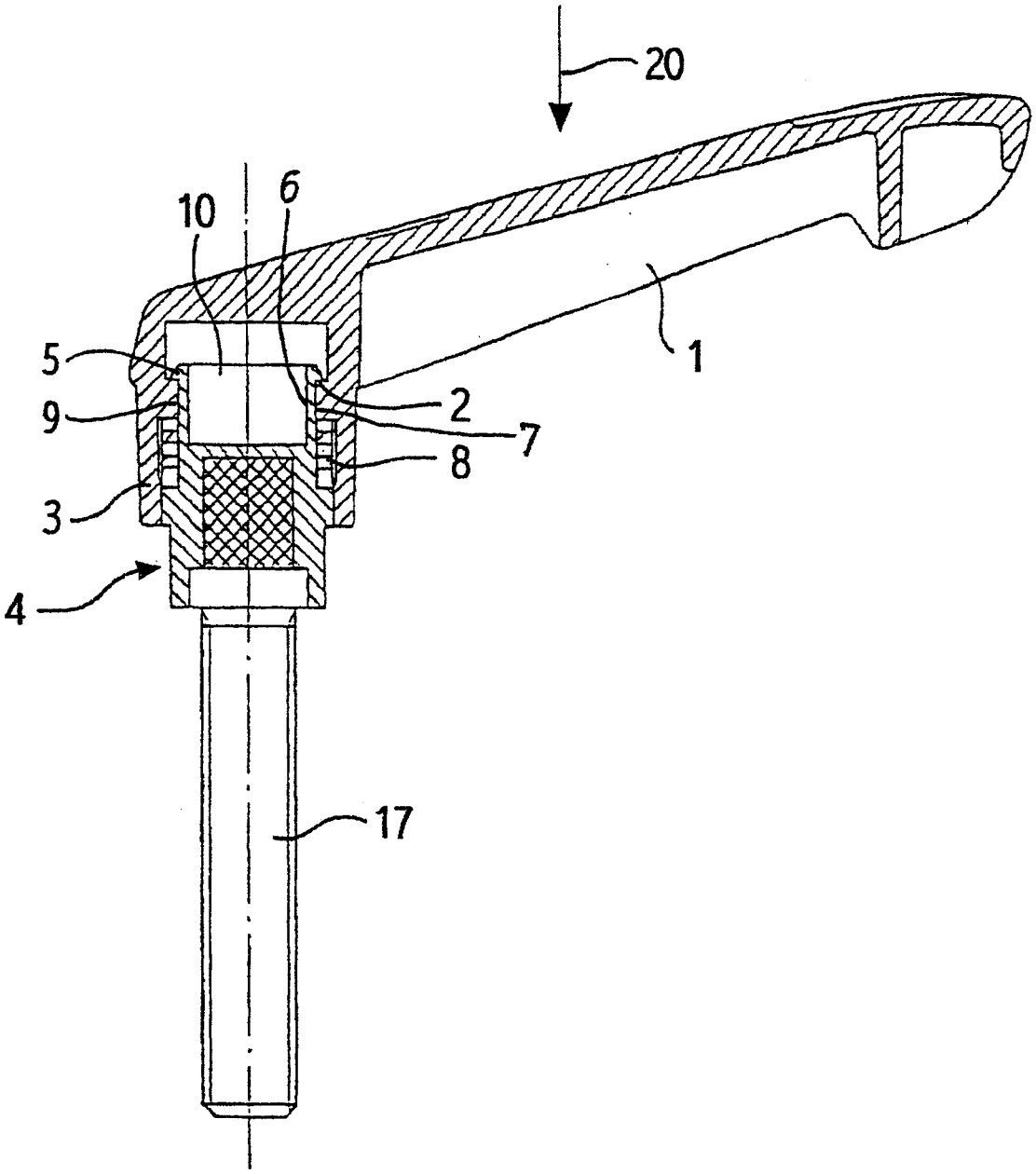
FIG. 2 is a sectional view of a hand lever with fastening element in accordance with a second embodiment of the invention.
Figure 3:
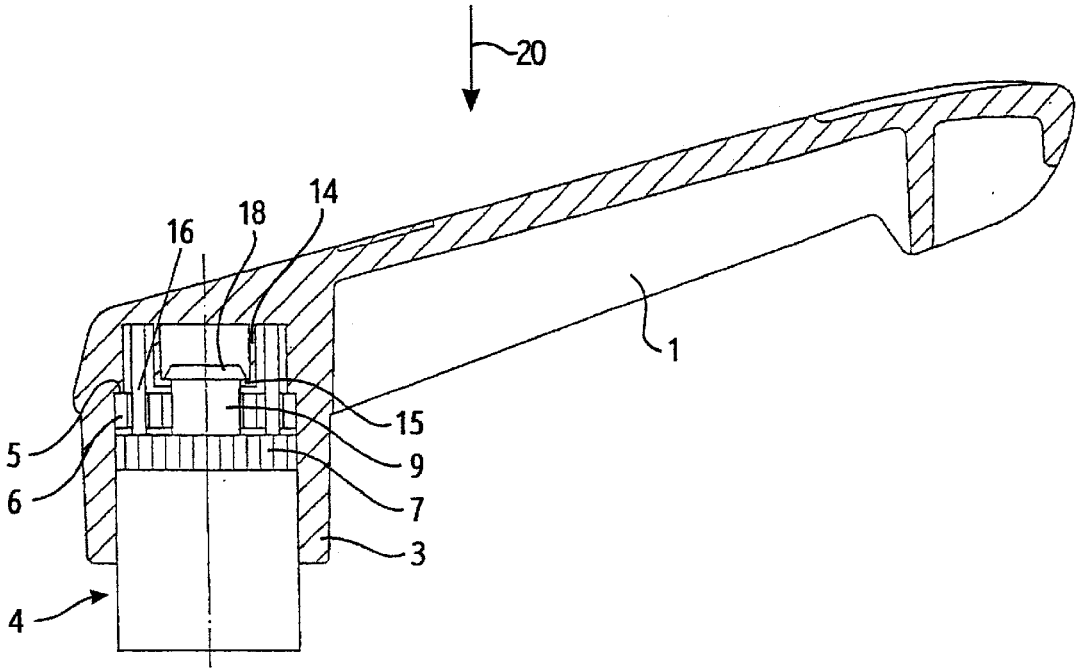
FIG. 3 is a sectional view of a hand lever with fastening element in accordance with a third embodiment of the invention.

As illustrated in FIGS. 1 to 3, the hand lever 1 includes a sleeve-shaped member 3 which is provided with a projection 3 which protrudes into the interior of the body 3. A fastening element 4 is mounted so as to be longitudinally slidable in the sleeve-shaped member 3, wherein the fastening element 4 includes a stop 5 which interacts with the projection 2 of the sleeve-shaped member 3. The hand lever is axially coupled by means of coupling elements 6, 7 so as to be nonrotatable relative to the fastening element 4. A spring 8 which rests in the sleeve-shaped member 3 is provided for the axially engageable and disengageable coupling between the hand lever 1 and the fastening element 4. At its lower end, the fastening element 4 has a receiving means for a spindle, shaft 17 or the like.

The fastening element 4 extends in one piece beyond the projection 2 of the sleeve-shaped member 3 and into the member 3 and, thus, forms an extension part 9. A second support is provided for the spring 8. This support can be provided either at the fastening element 4 or its extension part 9. At least the sleeve-shaped member 3 or the extension part 9 is of a resilient material.

FIG. 1 shows an embodiment of the invention in which the extension part 9 is closed at its end protruding into the sleeve-shaped member by an approximately cup-shaped cover 12. The cup-shaped cover 12 has a side wall 13 directed into the sleeve-shaped member, wherein the side wall 13 serves as a second support for the spring 8. For assembling the hand lever, the fastening element 4 is pushed with its extension part 9 into the sleeve-shaped member 3 and, after inserting the spring 8, the cup-shaped cover 12 is put on and locked together with the extension part 9.

In the second embodiment of the present invention shown in FIG. 2, the fastening element 4 includes the second support for the spring 8 underneath the projection 2 of the sleeve-shaped member 3. The extension part is of an elastic material and is hollow, as indicated at reference numeral 10. Consequently, the components can be easily assembled by merely pushing them into each other, wherein, due to the elasticity of the hollow space 10, the stops 5 slide past the projection 2 and are subsequently locked behind the projection 2.

In the embodiment shown in FIG. 3, a hollow cylinder 14 protrudes from the side of the hand lever 1 into the sleeve-shaped member 3. The hollow cylinder 14 has at its lower end an inwardly directed stop rim 15, wherein the approximately mushroom-shaped extension part 9 protrudes into the hollow cylinder 14 and the head piece 18 of the hollow cylinder 14 interacts with the stop rim 15. The sleeve-shaped member 3 is open at its end directed against the fastening element 4. An integrally injection molded spring element 16 is provided laterally of the hollow cylinder 14 at the sleeve-shaped member 3 or at the extension part 9. For assembling this embodiment, the components are pushed into each other, wherein the approximately mushroom-shaped extension part 9 engages in the hollow cylinder 14.

In all embodiments of the invention illustrated in FIGS. 1 to 3, the extension part 9 is of circular symmetrical construction at its upper end and the fastening element 4 is of circular symmetrical construction at its lower end, wherein the upper portion has a smaller circumference than the lower portion. Moreover, the extension part 9 has at its end protruding into the sleeve-shaped member 3 an annular projection 11 forming the second support for the spring in the embodiments of FIGS. 2 and 3 or as a stop in the embodiment of FIG. 1.

The coupling is disengaged in the embodiments of FIGS. 1 and 2 in the axial direction by holding the spindle, shaft 17 or the like and lifting the hand lever 1 in the direction of arrow 19, as shown in FIG. 1, or against the direction of arrow 20, as shown in FIG. 2, while simultaneously tensioning the spring 8. By turning the hand lever 1 by a predetermined angle, the hand lever 1 is then once again released, the spring 8 is untensioned and the coupling can once again be engaged or locked. The relative axial movement between the hand lever 1 and the fastening element 4 can be limited by a blocking position of the spring 8 after a predetermined pressing movement of the hand lever 1.

In the embodiment of the invention shown in FIG. 3, the coupling is engaged in the axial direction by holding the spindle, shaft 17 or the like and pressing the hand lever 1 in the direction of arrow 20 while simultaneously tensioning the spring 8. When the spring 8 is untensioned, the coupling elements 6, 7 are not in positive engagement and the stop rim 15 as well as the head piece 18 of the hollow cylinder 14 are in engagement with each other. In this manner, the upward movement of the hand lever 1 is limited. When the hand lever 1 is moved downwardly in the direction of arrow 20, the stop rim 15 and the head piece 18 are disengaged and the coupling elements 6, 7 are axially coupled so as to be nonrotatable relative to each other. The stop rim 15 simultaneously limits the movement of the sleeve-shaped member 3 in the direction of arrow 20.

While specific embodiments of the invention have been shown and described in detail to illustrate the inventive principles, it will be understood that the invention may be embodied otherwise without departing from such principles.

What is claimed is:

1. A hand lever comprising:

a sleeve-shaped member having an inwardly protruding projection, a fastening element having a stop directly interacting with the projection, wherein the fastening element is mounted in the sleeve-shaped member so as to be longitudinally slidable to a limited extent, coupling elements for axially coupling the hand lever and the fastening element so as to be nonrotatable relative to each other, a spring directly received in the sleeve-shaped member as a first support of the spring for an axially engageable and disengageable coupling of the hand lever and the fastening element, the fastening element having an integrally formed extension part extending in one piece with the fastening element past the projection of the sleeve-shaped member into the sleeve-shaped member, a second support for the spring and the stop provided on the fastening element or the extension part, wherein at least one of the sleeve-shaped member and the extension part is of a resilient material such that the sleeve-shaped member and the extension part can be pushed and locked together.

2. The hand lever according to claim 1, wherein the extension part has a hollow space and is of an elastic material.

3. The hand lever according to claim 1, wherein the extension part has at an end thereof protruding into the sleeve-shaped member an annular projection forming the second support for the spring.

4. The hand lever according to claim 1, wherein the extension part has at an end thereof protruding into the sleeve-shaped member an annular projection forming the second support for the spring or forming the stop.

5. The hand lever according to claim 1, wherein the fastening element comprises the second support for the spring.

6. The hand lever according to claim 1, wherein the extension part has an upper end and the fastening element has a lower end, wherein the upper end and the lower end are each of circular symmetrical construction, wherein the upper end has a smaller circumference than the lower end.

7. The hand lever according to claim 1, further comprising a hollow cylinder protruding into the sleeve-shaped member from a side of the hand lever, wherein the hollow cylinder has at a lower end thereof an inwardly directed stop rim and wherein the extension part is approximately mushroom-shaped and protrudes into the hollow cylinder and a head part of the extension part is configured to interact with the stop rim.

8. The hand lever according to claim 7, wherein the sleeve-shaped member is of an elastic material and wherein a spring element is mounted laterally of the hollow cylinder at the sleeve-shaped member or at the extension part.

9. The hand lever according to claim 1, wherein the sleeve-shaped member is open at an end thereof directed against the fastening element.

10. A hand lever comprising:

a sleeve-shaped member having an inwardly protruding projection, a fastening element having a stop interacting with the projection, wherein the fastening element is mounted in the sleeve-shaped member so as to be longitudinally slidable to a limited extent, coupling elements for axially coupling the hand lever and the fastening element so as to be nonrotatable relative to each other, a spring received in the sleeve-shaped member as a first support of the spring for an axially engageable and disengageable coupling of the hand lever and the fastening element, the fastening element having an integrally formed extension part extending past the projection of the sleeve-shaped member into the sleeve-shaped member, a second support for the spring and the stop provided on the fastening element or the extension part, wherein at least one of the sleeve-shaped member and the extension part is of a resilient material, further comprising an approximately cup-shaped cover for closing the extension part at an end thereof protruding into the sleeve-shaped body, wherein the cover has a side wall directed into the sleeve-shaped member and serving as the second support for the spring.

* * * * *